US005979795A

United States Patent [19]

Chen

[11] Patent Number: 5,979,795

[45] Date of Patent: Nov. 9, 1999

[54] SPRINKLER CAPABLE OF SPRINKLING UNIFORMLY AN INTENDED AREA

[76] Inventor: Sheng Horng Chen, 38, Alley 95, Lane 8b, Tong Kuang Yuan Rd., Taichung, Taiwan

[21] Appl. No.: 09/072,683

[22] Filed: May 6, 1998

[51] Int. Cl.[6] ..... B05B 3/16

[52] U.S. Cl. ..... 239/242; 239/263.3

[58] Field of Search ..... 239/225.1, 236, 239/237, 240, 242, 263.3, 380, 381, 390, 391, 397

[56] References Cited

U.S. PATENT DOCUMENTS 4,568,024 2/1986 Hunter ..... 239/242

5,673,855 10/1997 Nguyen et al. ..... 239/242 X 5,758,827 6/1998 Van Le et al. ..... 239/242

*Primary Examiner*—Kevin P. Shaver

*Assistant Examiner*—Sean P. O'Hanlon

*Attorney, Agent, or Firm*—Bacon & Thomas

[57] ABSTRACT

A sprinkler is composed of a nozzle, a tubular body, a first transmission gear set, and a second transmission gear set. The first transmission gear set and the second transmission gear set are mounted on the tubular body such that the first transmission gear set and the second transmission gear set are linked with a drive wheel capable of being actuated by the water pressure, and that an output gear of the nozzle can be so adjusted as to locate at one of the locating holes for sprinkling a specific section of an area intended to be sprinkled.

1 Claim, 11 Drawing Sheets

SPRINKLER CAPABLE OF SPRINKLING UNIFORMLY AN INTENDED AREA

FIELD OF THE INVENTION

The present invention relates generally to a water sprinkler, and more particularly to a water sprinkler having a nozzle that can be adjusted to sprinkle uniformly an intended area.

BACKGROUND OF THE INVENTION

There are a variety of water sprinklers available in the market place today; nevertheless these conventional water sprinklers have one thing in common in that they are incapable of sprinkling uniformly an intended area at the same time, and that they miss the fringe area of the intended area, and further that they are not cost-effective in terms of water consumption.

SUMMARY OF THE INVENTION

The primary objective of the present invention is to provide a sprinkler with a nozzle that can be so adjusted as to sprinkle uniformly an intended area.

In keeping with the principle of the present invention, the foregoing objective of the present invention is attained by an improved sprinkler consisting of a nozzle, a tubular body, and a transmission set. The transmission set is mounted on the tubular body such that a first transmission gear set and a second transmission set of the transmission set are linked by a drive wheel capable of being actuated by the water pressure, thereby enabling an output gear of the nozzle to be located at a specific position for sprinkling a specific section of an intended area.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
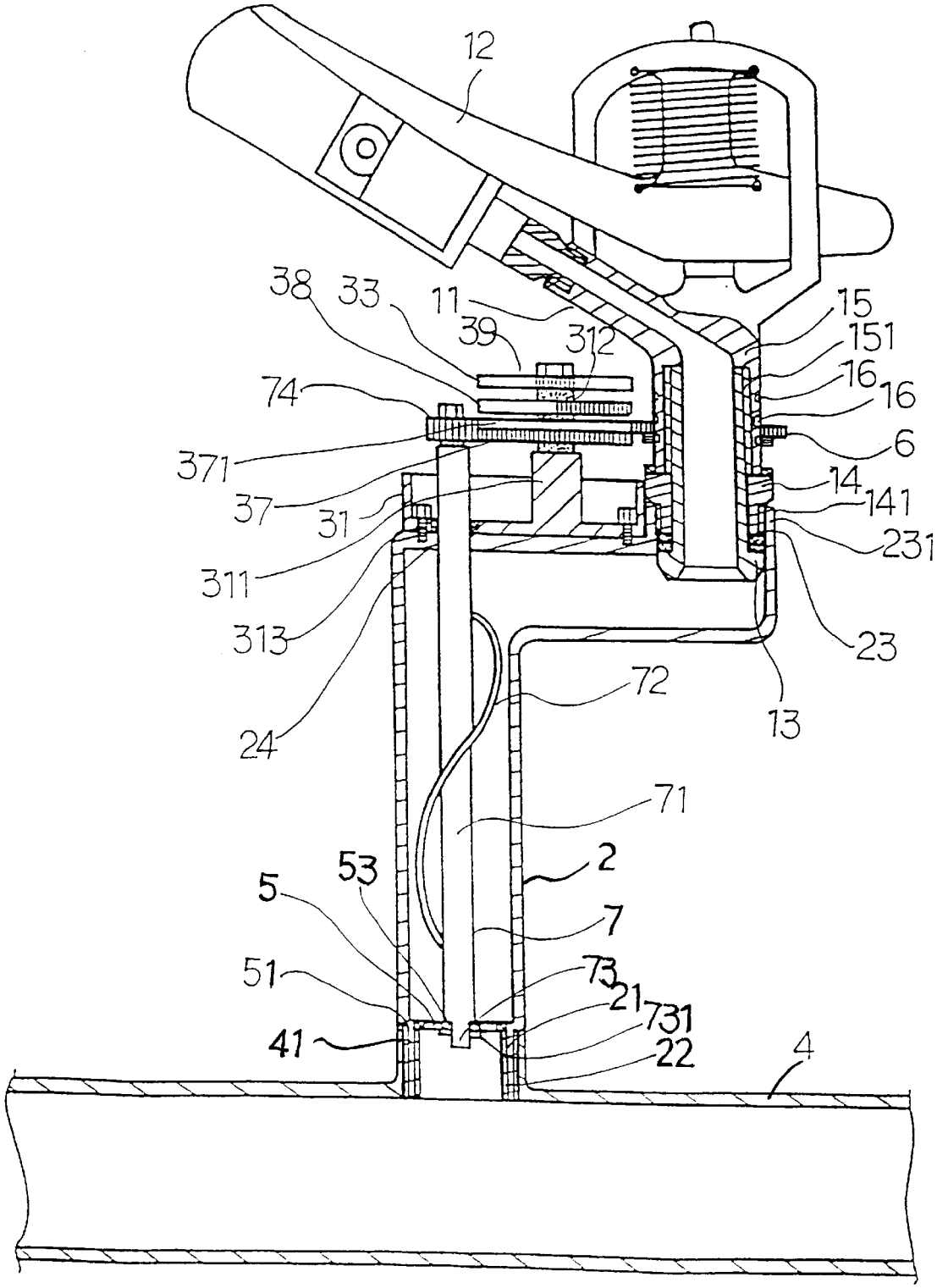
FIG. 1 shows a longitudinal sectional view of a preferred embodiment of the present invention in combination.
Figure 2:
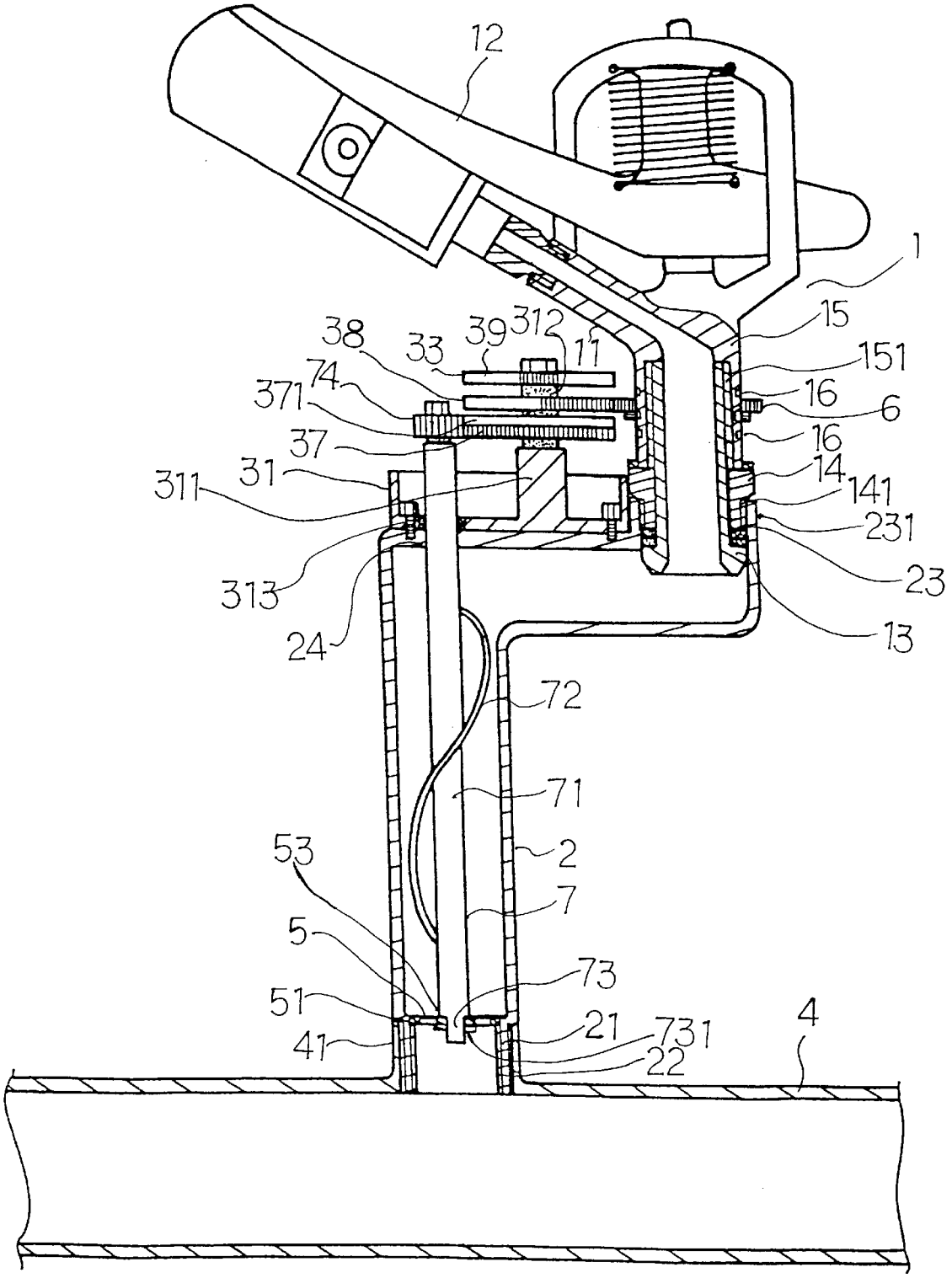
FIG. 2 shows a sectional view of a second preferred embodiment of the present invention.
Figure 3:
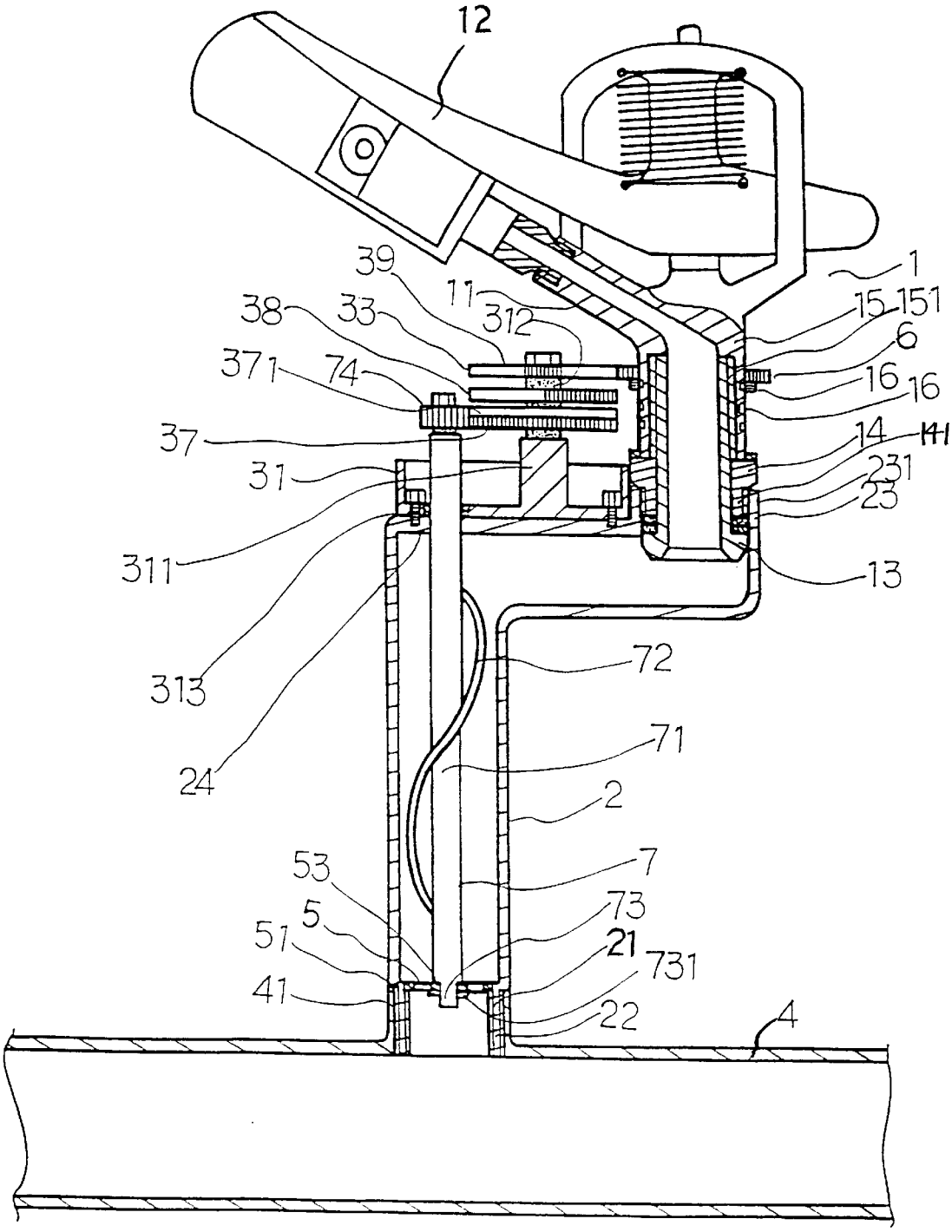
FIG. 3 shows a sectional view of a third preferred embodiment of the present invention in combination.

As shown in FIGS. 1, 2, and 3, a sprinkler of the present invention is composed of a nozzle 1, a tubular body 2, and a transmission set 3.

Figure 3A:
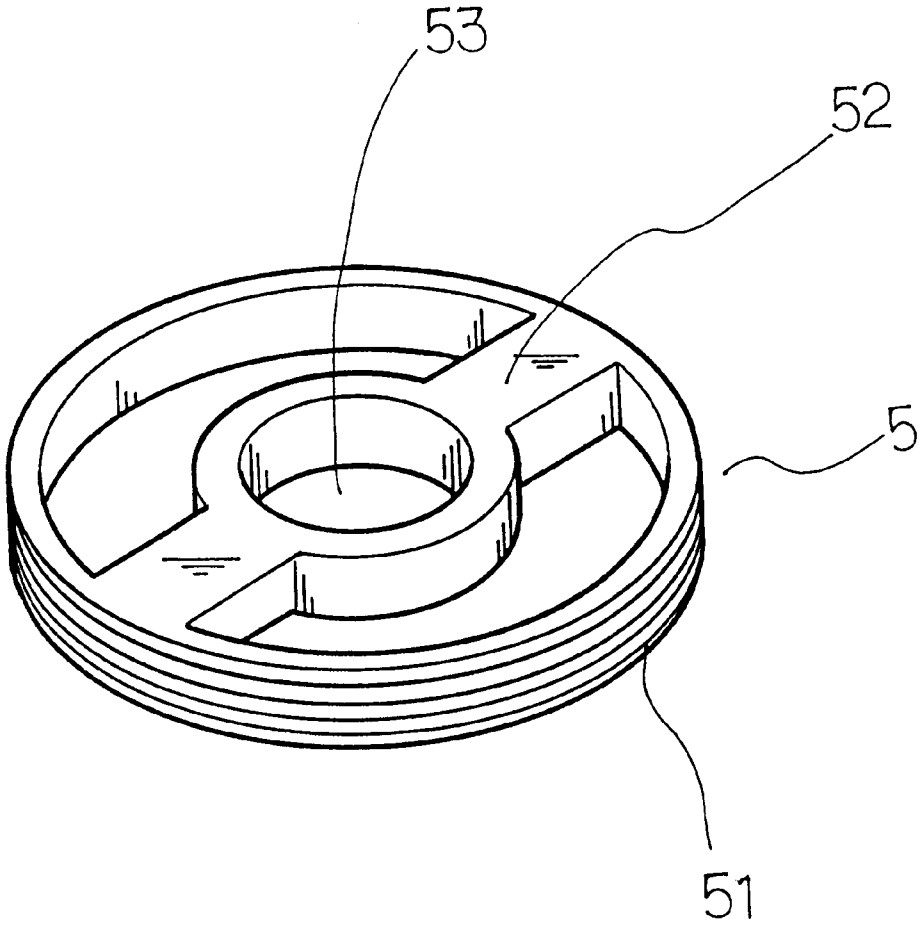
FIG. 3A shows a perspective view of a fastening ring of the present invention.

The tubular body 2 is of a hollow construction and is provided at the longitudinal bottom end thereof with an inner threaded section 21 and an outer threaded section 22 which is engaged with an outlet 41 of a water hose 4. The inner thread section 21 is engaged with a fastening ring 5 which is provided with outer threads 51, as shown in FIG. 3A. The fastening ring 5 is provided at the center thereof with a reinforcing body 52, which is connected with a connection ring 53. The tubular body 2 is further provided at a water outlet thereof with a pivoting body 23 which is provided with inner threads 231.

Figure 1A:
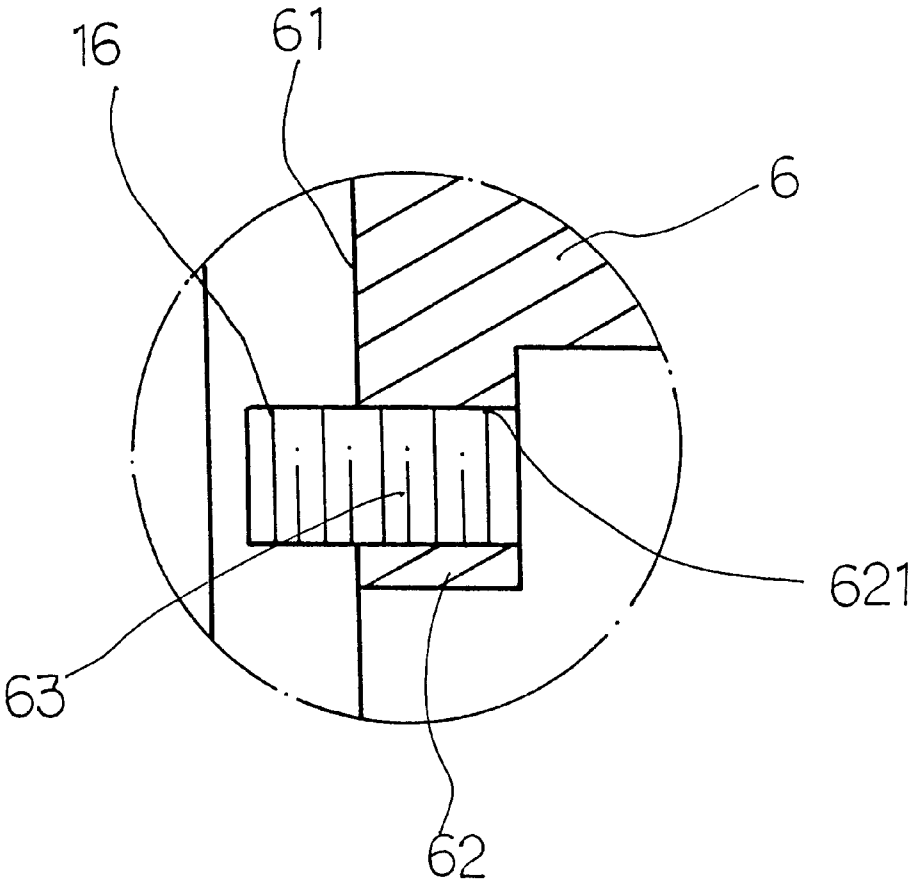
FIG. 1A shows a sectional view of an output gear and a nozzle of the present invention.

The nozzle 1 is formed of a main body 11, a swing wing 12, a pivot 13, and a nut fitting body 14. The nut fitting body 14 is provided with an outer threaded sectional 141, which is engaged with the inner threads 231 of the pivoting body 23 of the inverted L-shaped tubular body 2. The pivot 13 has a front end which is fitted into the nut fitting body 14 and is engaged with the inner threads 151 of a cylindrical main body 15 of the nozzle 1, thereby enabling the nozzle 1 to rotate freely. The cylindrical main body 15 is provided with a locating hole 16 and an output gear 6 having a center hole 61 which is provided with a protruded block 62 having a threaded through hole 621 for engaging a locating bolt 63, as shown in FIG. 1A. The position of the output gear 6 is adjusted by the locating bolt 63.

Figure 1B:
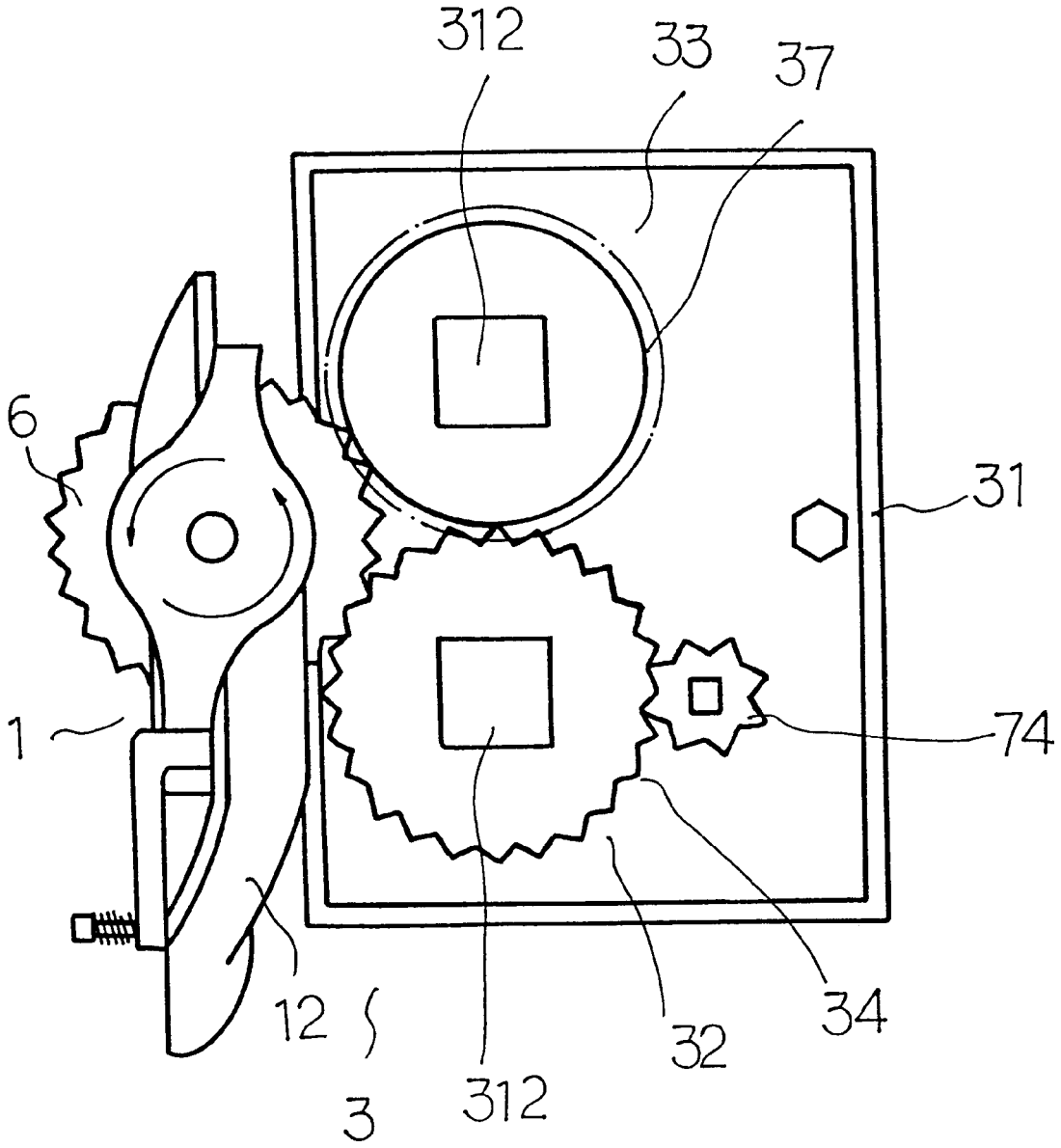
FIG. 1B shows a top view of the first preferred embodiment of the present invention.
Figure 2A:
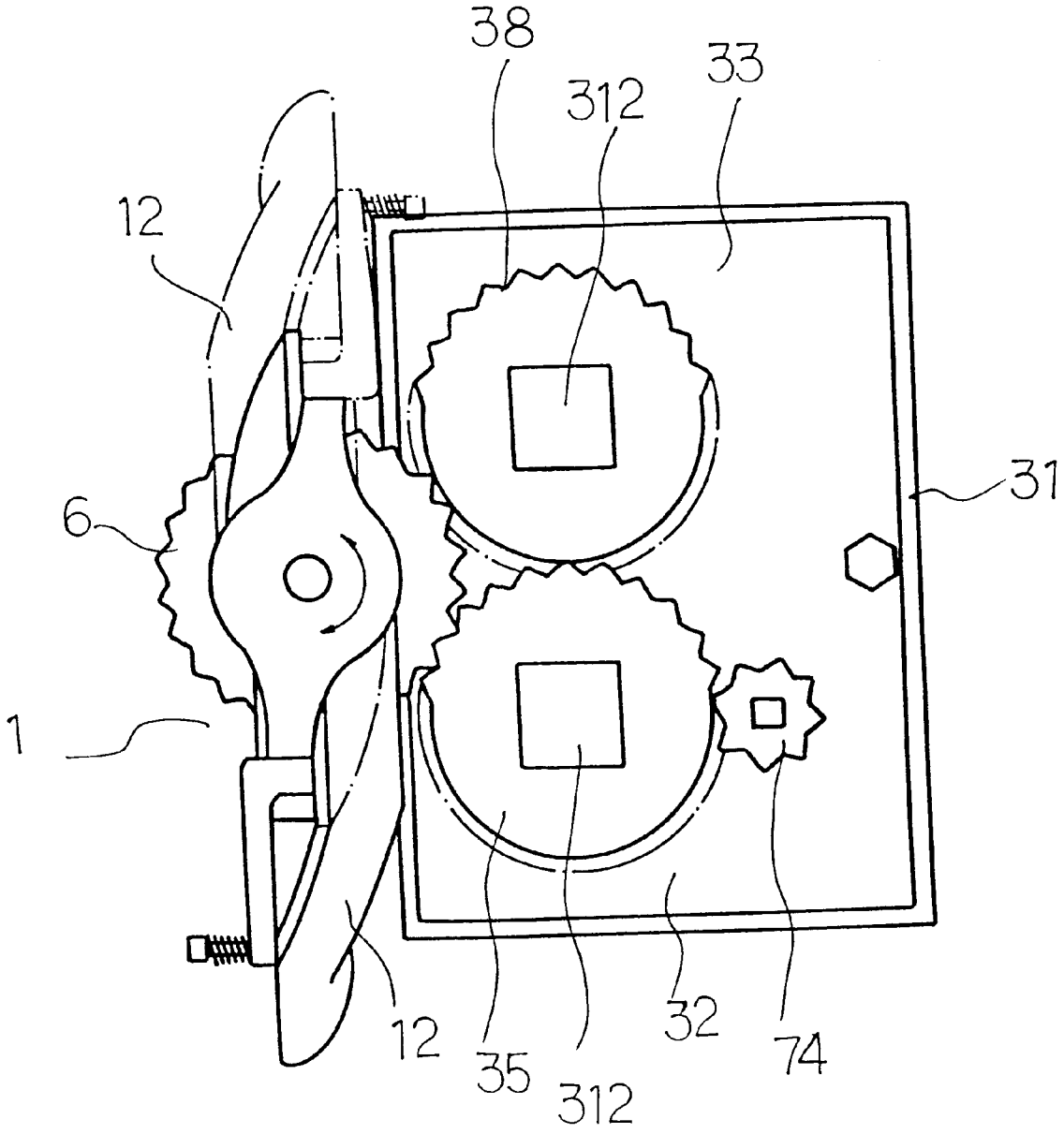
FIG. 2A shows a top view of the second preferred embodiment of the present invention.
Figure 3B:
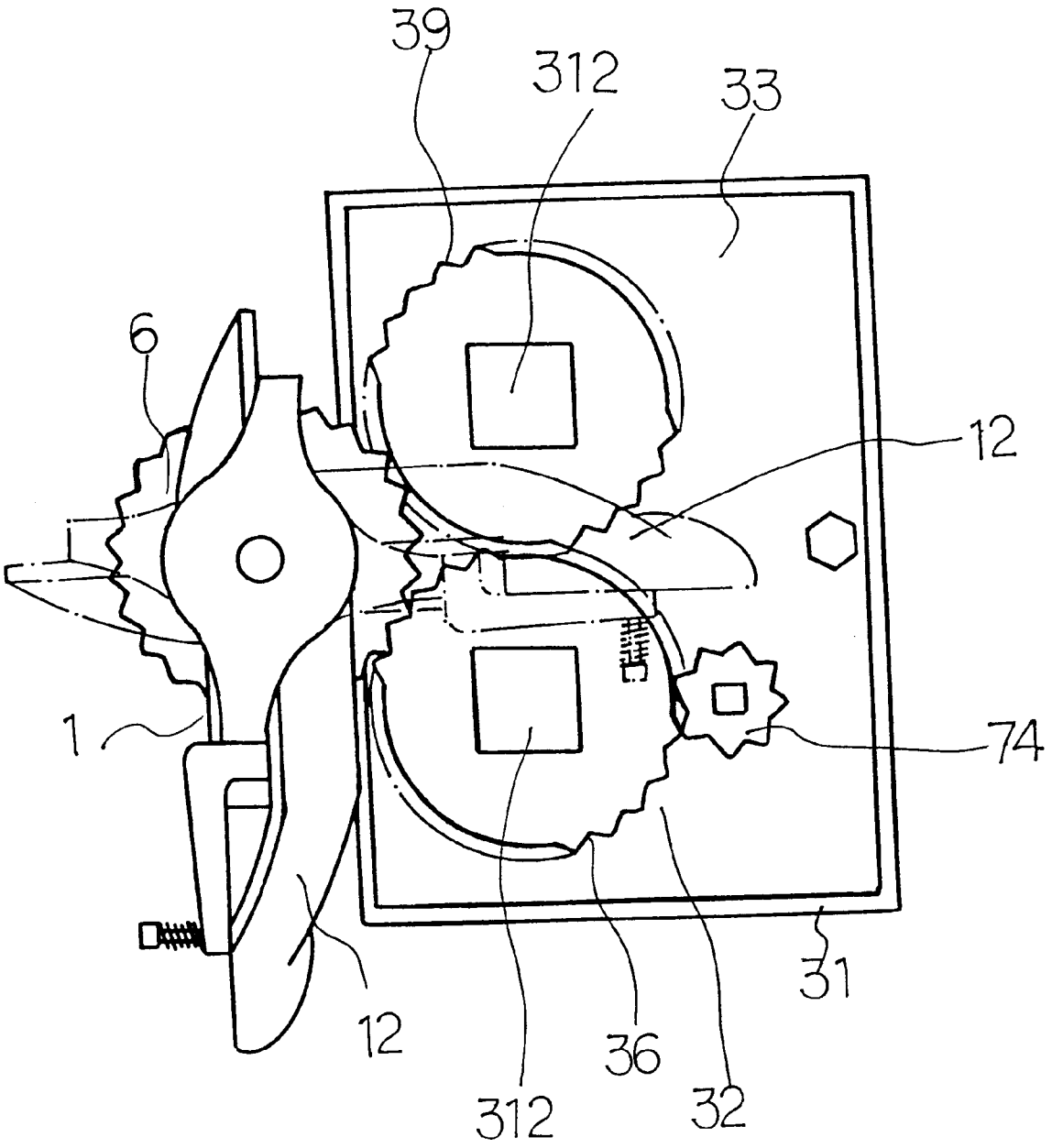
FIG. 3B shows a top view of the third preferred embodiment of the present invention.

As shown in FIG. 1B, FIG. 2A, and FIG. 3B, the tubular body 2 is fastened with a recessed plated body 31 which is provided with two columnar bodies 311 having an axis 312 for mounting a first transmission set 32 and a second transmission set 33. The first transmission set 32 is provided with a whole area gear 34, a half area gear 35, a quarter area gear 36. The second transmission set 33 is provided with a whole area gear 37, a half area gear 38, and a quarter area gear 39. The gear 34 is engaged with the gear 37. A drive shaft 7 has a shaft rod 71 which is provided with a spiral blade 72 and a shaft column 73 fitted into the connection ring 53 to urge the shaft rod 71. The shaft column 73 is provided with a C-shaped retaining ring 731 for preventing the shaft rod 71 from being forced out by the water impetus. The top of the shaft rod 71 is put through the axial holes 24 and 313 of the tubular body 2 and the recessed plate body 31. A drive gear 74 is mounted on the top end of the shaft rod 71 such that the drive gear 74 is engaged with the gear 34. The output gear 6 is engaged with the first transmission gear set 32 and the second transmission gear set 33.

Figure 1C:
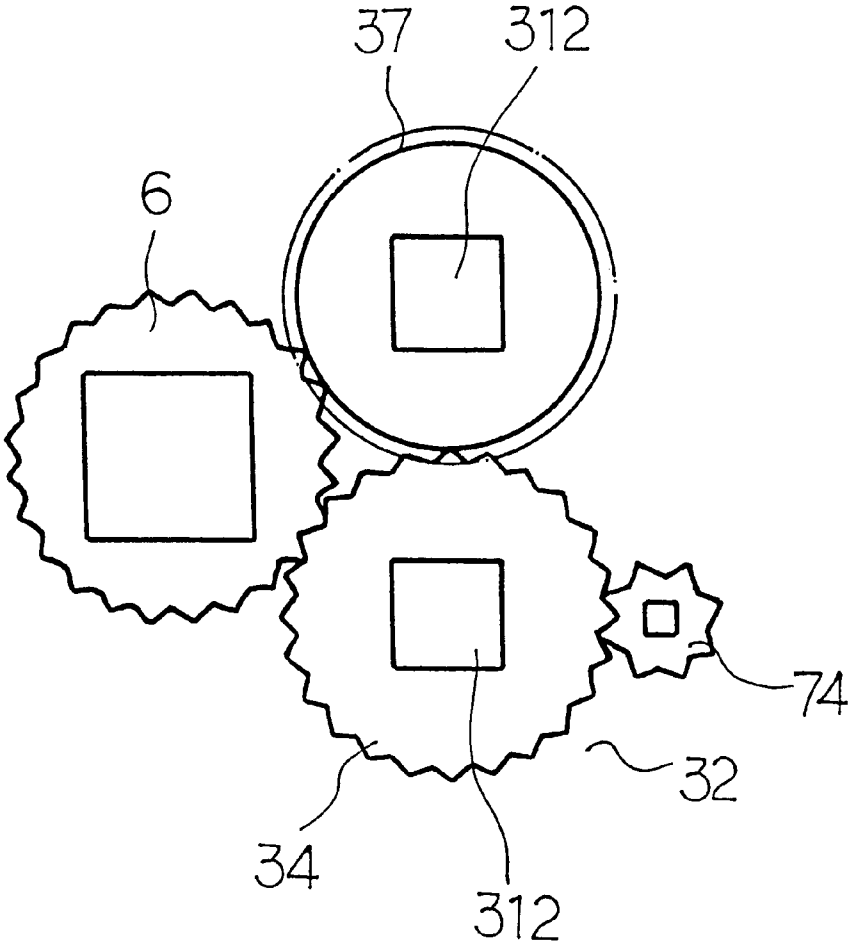
FIG. 1C shows a schematic view of the transmission of the first preferred embodiment of the present invention.

As shows in FIGS. 1, 1B, and 1C, the output gear 6 is first adjusted such that the output gear 6 is located at the lowest locating hole 16, and that the output gear 6 is engaged with the gear 34, and further that the output gear 6 is opposite to a flat portion 371 of the gear 37. In light of the output gear 6 being linked with the gear 33, the water in the water hose 4 is allowed to flow to the drive shaft 7 via the water outlet 41, thereby causing the spiral blade 72 to be driven by the water to actuate the drive shaft 7 and the drive gear 74 to rotate. The gear 34 is linked with the drive gear 74 and the output gear 6. Both the output gear 6 and the nozzle 1 can thus rotate continuously to sprinkle an intended area in its entirety.

Figure 2B:
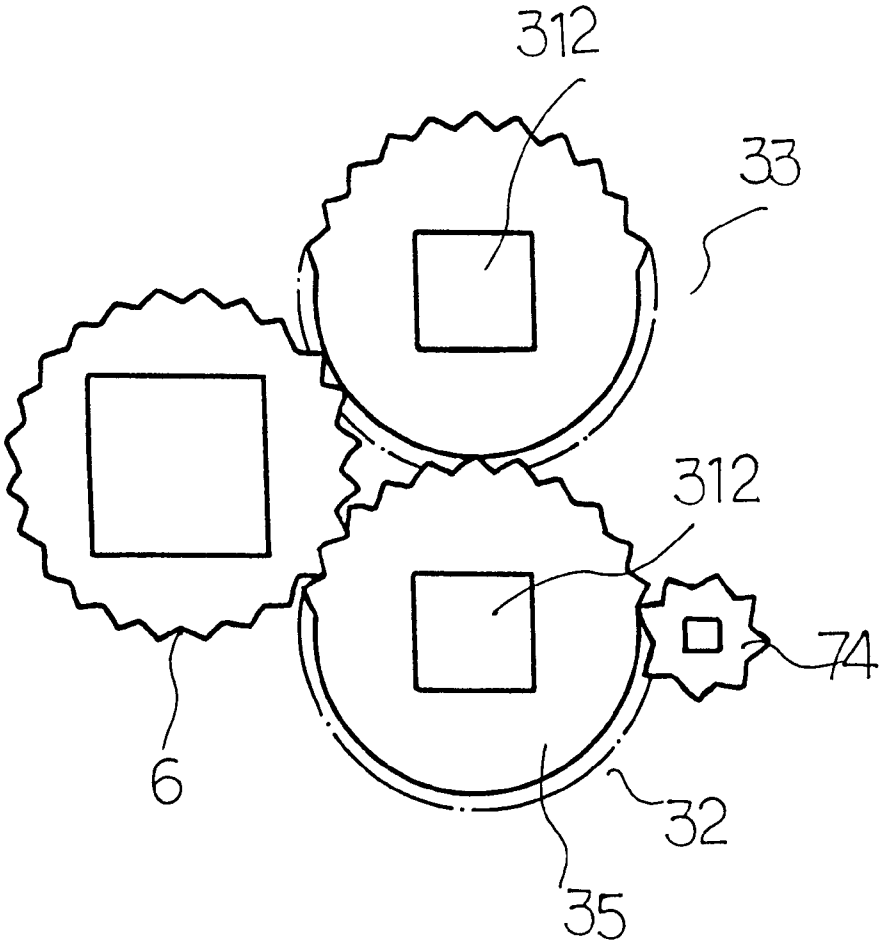
FIG. 2B shows a schematic view of the transmission of the second preferred embodiment of the present invention.

As shown in FIGS. 2, 2A, and 2B, the output gear 6 is first adjusted to locate at the intermediate locating hole 16 such that the output gear 6 is engaged with the gear 35 of the first transmission gear set 32 and the gear 38 of the second transmission gear set 33. As soon as the water in the water hose 4 is introduced via the water outlet 41 to drive the spiral blade 72 so as to cause the drive shaft to rotated. In the meantime, the drive gear 74 is actuated to turn clockwise such that the gear 34 of the first transmission gear set 32 is linked, and that the gears 35 and 36 of the first transmission gear set 32 to turn counterclockwise. The gear 37 of the second transmission gear set 33 is linked with the gear 34 such that the gears 38 and 39 of the second transmission gear set 33 to turn clockwise. As the output gear 6 is linked with the gear 35 of the first transmission gear set 32, the output gear 6 and the nozzle 1 rotate clockwise. When the gear 35 has turned 180 degrees, the output gear 6 is no longer linked. However, the output gear 6 is linked with the gear 38 so as to cause the nozzle 1 to turn counterclockwise. As a result, the rotation of the nozzle 1 is confined to an angle of 180 degrees. In other words, the sprinkling area is confined to the 180-degree area.

Figure 3C:
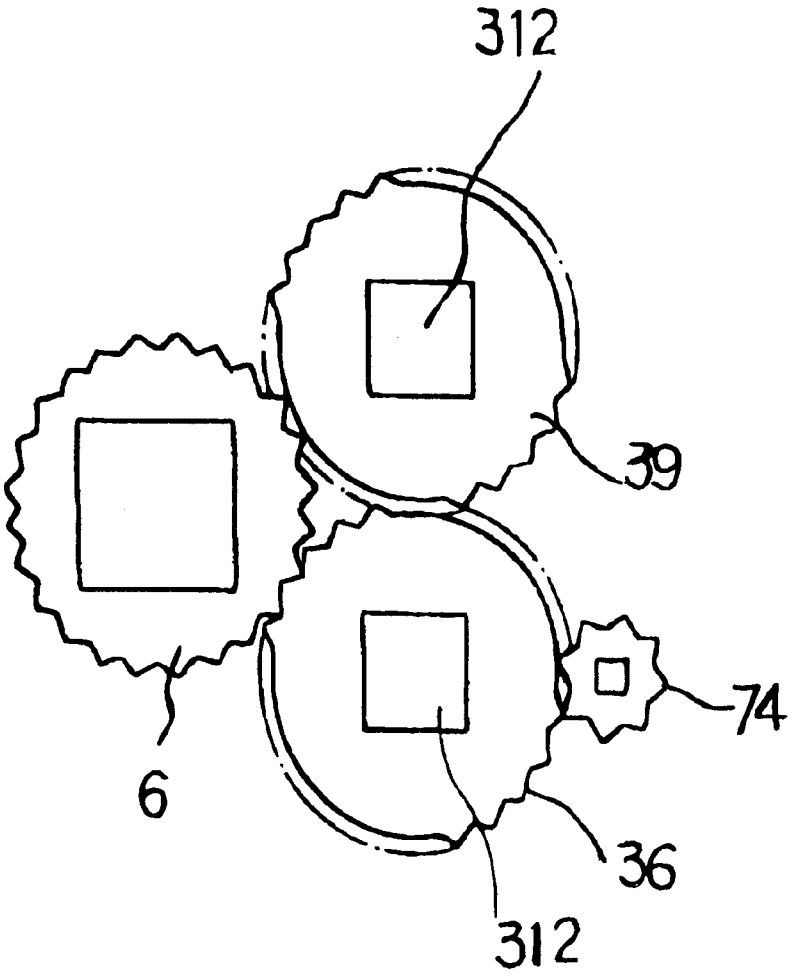
FIG. 3C shows a schematic view of the transmission of the third preferred embodiment of the present invention.

As shown in FIGS. 3, 3B, and 3C, the output gear 6 is so adjusted as to locate at the highest locating hole 16 such that the output gear 6 is engaged with the gear 36 of the first transmission gear set 32, and that the output gear 6 is engaged with the gear 39 of the second transmission gear set 33. As the spiral blade 72 is driven by the water of the water hose 4, the drive shaft 7 is actuated to turn such that the drive gear 74 turns clockwise, thereby resulting in the gears 34 and 35, 36 of the first transmission gear set 32 to turn counterclockwise. In the meantime, the gear 37, 38 and 39 of the second transmission gear set 33 are linked by the gear 34 so as to turn clockwise. As the output gear 6 is linked with the gear 36 of the first transmission gear set 32, both the output gear 6 and the nozzle 1 are caused to turn clockwise. As the gear 36 has turned an angle of 90 degrees, the output gear 6 is no longer linked. The output gear 6 is then linked with the gear 39 so as to cause the nozzle 1 to turn counterclockwise, thereby confining the sprinkling to one quarter of an intended area.

It is therefore readily apparent that the present invention can be so adjusted as to confine the sprinkling of water by the nozzle 1 to an intended area in its entirety, one half of the intended area, or one quarter of the intended area.

What is claimed is:

1. A sprinkler comprising:

a tubular body of an inverted L-shaped construction and provided at a bottom end of a longitudinal axis thereof with an inner threaded section and an outer threaded section which is engaged with an outlet of a water hose, said inner threaded section being engaged with a fastening ring having outer threads, said fastening ring connected with a connection ring and provided with a pivoting body having inner threads;

a nozzle formed of a main body, a swing wing, a pivot, and a nut fitting body having outer threads engaging said inner threads of said pivoting body, said pivot being engaged with inner threads of a cylindrical main body of said nozzle to enable said nozzle to rotate freely, said cylindrical main body provided with a plurality of a locating holes located equidistantly and at different levels, said nozzle provided with an output gear capable of being located at said locating holes; and a transmission set fastened with said tubular body by a recessed plate body which is provided with two shaft bodies on which a first transmission gear set and a second transmission gear set are mounted, said first transmission gear set composed of a full area gear, a one-half area gear, and a one-quarter area gear, said second transmission gear set composed of a full area gear having a flat portion, a one-half area gear, and a one-quarter area gear, said full area gear of said first transmission gear set being engaged with said full area gear of said second transmission gear set, a drive shaft provided with a spiral blade, said drive shaft having a bottom end being fitted into said connection ring of said fastening ring of said tubular body and provided with a C-shaped retaining ring, said drive shaft provided with a drive gear which is engaged with said full area gear of said first transmission gear set, an output gear engaged with said first transmission gear set and said second transmission gear set such that said output gear can be so adjusted as to locate at one of said locating holes.

* * * * *